US006264389B1

(12) United States Patent
Ducharme

(10) Patent No.: US 6,264,389 B1
(45) Date of Patent: Jul. 24, 2001

(54) CONVERTIBLE WRITING INSTRUMENT

(76) Inventor: Robert R. Ducharme, 402 First St., Orlando, FL (US) 32824

( * ) Notice: Subject to any disclaimer, the term of this patent is extended or adjusted under 35 U.S.C. 154(b) by 0 days.

(21) Appl. No.: 09/685,618

(22) Filed: Oct. 10, 2000

(51) Int. Cl.[7] ..... B43K 5/16
(52) U.S. Cl. ..... 401/116; 401/195; 401/107
(58) Field of Search ..... 401/116, 99, 117, 401/107, 195

(56) References Cited

U.S. PATENT DOCUMENTS

| | | |
|---|---|---|
| D. 260,905 | 9/1981 | Klaber . |
| D. 276,479 | 11/1984 | Mori . |
| D. 310,449 | 9/1990 | Agrippino . |
| D. 332,625 | 1/1993 | LaPerche . |
| 3,994,605 | 11/1976 | McKnight . |
| 4,081,217 | 3/1978 | Klaber . |
| 4,317,638 | 3/1982 | Klaber . |
| 4,833,902 | 5/1989 | Mori . |
| 4,974,982 | 12/1990 | Neilson . |
| 5,547,301 | 8/1996 | Kageyama et al. . |

*Primary Examiner*—David J. Walczak
(74) *Attorney, Agent, or Firm*—Dale J. Ream

(57) ABSTRACT

A writing instrument comprises a front tubular member having a threaded end and a conically configured end. The writing instrument further includes a rear tubular member having a threaded open end adapted to selectively engage the threaded end of the front member in either a storage or use configuration. An inner front tubular member is disposed in the front tubular member and is not rotatable therein. The inner front tubular member defines an inclined path at an oblique angle relative to a longitudinal axis thereof. A tubular actuator member is coupled to the inner front tubular member and is rotatable relative thereto. The actuator member includes a hub adapted to engage the inclined path and move therein upon rotation of the actuator member. A writing refill is inserted in the actuator and inner front tubular members. The refill includes a writing tip at one end and a knob at an opposed end. A rotation of the knob causes a corresponding rotation of the refill and, therefore, an extension or retraction of the writing tip relative to the conical end of the front tubular member. The threaded ends of the front and rear tubular members allow these members to be threadably coupled together in storage or use configurations.

15 Claims, 4 Drawing Sheets

10
5

66
38
30
12
5
38

34
32
66
30
36
20
38
26
22
18

16
14
34
64
24
14
10
30
32
64
24

CONVERTIBLE WRITING INSTRUMENT

BACKGROUND OF THE INVENTION

This invention relates generally to writing instruments and, more particularly, to a writing instrument which may be conveniently converted from a compact storage configuration to a lengthened writing configuration. More particularly, a writing portion may be selectively stored within a case or attached thereto for use in writing.

Various devices have been proposed in the art for providing compact writing instruments that are convertible from a storage configuration to a writing configuration, such as the device disclosed in U.S. Pat. No. 4,974,982. In addition, devices have been proposed for advancing or retracting a writing element by rotation of the writing instrument housings. Although assumably effective for their intended purposes, these devices do not provide the ability to threadably attach or detach a writing element from a case without consequently rotatably advancing or retracting the writing element itself.

Therefore, it is desirable to have a writing instrument which is selectively threadably held in a storage configuration within a tubular housing or threadably attached to the housing in a writing configuration. Further, it is desirable to have a writing instrument in which a writing element may be advanced or retracted without disrupting the threaded relationship between the writing portion and housing portion.

SUMMARY OF THE INVENTION

A writing instrument according to the present invention includes a front tubular member having an externally threaded end and a conical tip end. The writing instrument further includes a rear tubular member having an internally threaded open end and an opposed closed end. The externally threaded end of the front tubular member may be removably coupled to the threaded open end of the rear tubular member either with the front tubular member inserted in the rear tubular member or extending therefrom. In other words, the front and rear tubular members may be converted from a storage configuration to a use position using the same threaded attachment structures. It should be appreciated that rotation of the front tubular member relative to the rear tubular member plays no part in the advancement or retraction of the writing element itself. A loop or latch is attached to the closed end of the rear tubular member such that the writing instrument may be coupled to a key ring.

An inner front tubular member is disposed in the front tubular member and is not rotatable therein. The inner front tubular member defines an inclined path at an oblique angle relative to the longitudinal axis thereof. A tubular actuator member is coupled to the inner front tubular member and is adapted to rotate relative thereto. The actuator member includes a hub that engages the inclined path and moves between ends thereof as the actuator member is rotated. The actuator member includes a threaded end opposite the hub. The writing instrument further includes a writing refill inserted writing-tip-first into the inner front and actuator members. A tubular knob is attached to the refill opposite the writing tip end and is threaded for engagement with the threaded end of the actuator member. Therefore, the refill and actuator members are rotated upon a user rotation of the knob. Such a rotation causes the writing tip to extend or retract from the conical end of the front tubular member because of the oblique angle of the inclined path and the engagement of the hub therein. It should again be appreciated that extension or retraction of the writing element is dependent upon rotation of the knob rather than of the front and rear tubular members.

Therefore, a general object of this invention is to provide a writing instrument that may be attached to a key ring and carried in a compact, storage configuration.

Another object of this invention is to provide a writing instrument, as aforesaid, which is easily attachable or detachable from a key ring with a spring-biased latch assembly.

Still another object of this invention is to provide a writing instrument, as aforesaid, having front and rear tubular members which may be threadably coupled or separated without also extending or retracting a writing element from the front member.

A further object of this invention is to provide a writing instrument, as aforesaid, which is easy and economical to manufacture and simple to use.

Other objects and advantages of this invention will become apparent from the following description taken in connection with the accompanying drawings, wherein is set forth by way of illustration and example, embodiments of this invention.

DESCRIPTION OF THE PREFERRED EMBODIMENT

Figures 1, 2, 3:
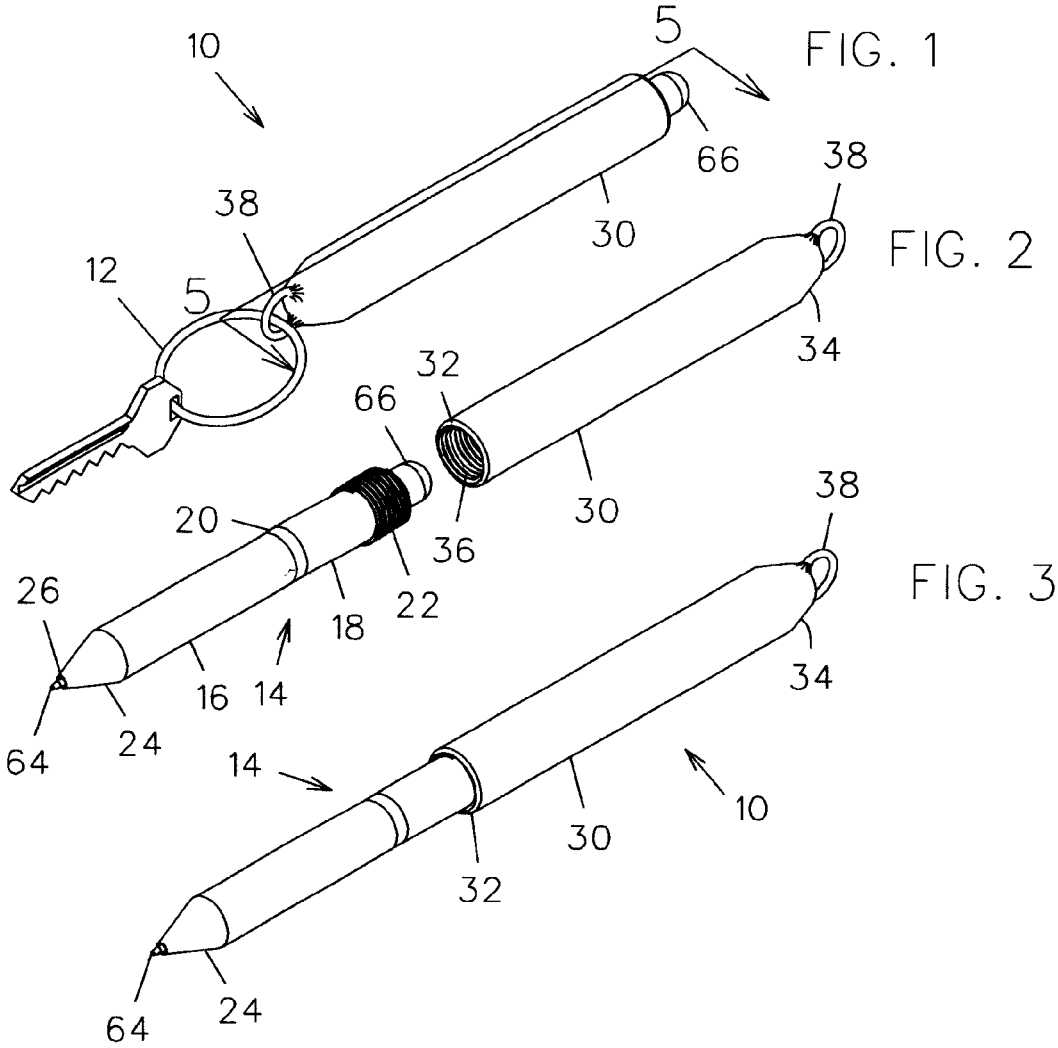
FIG. 1 is a perspective view of a writing instrument according to the present invention with front and rear tubular members coupled in a storage configuration.
FIG. 2 is a perspective view of the writing instrument as in FIG. 1 with the front tubular member positioned for attachment to the rear portion in a use configuration.
FIG. 3 is a perspective view of the writing instrument as in FIG. 1 with the front and rear tubular members coupled in a use configuration.

A writing instrument according to the present invention will now be described with reference to FIGS. 1–8 of the accompanying drawings. According to one embodiment of the invention, a writing instrument 10 includes a front tubular member 14 that may be threadably coupled to a rear tubular member 30 in either a storage configuration (FIG. 1) or a use configuration (FIG. 3). The tubular members 14, 30 are constructed of a durable plastic material although a metal material would also be suitable. The front tubular member 14 includes a first portion 16 frictionally attached to a second portion 18 and separated by a divider ring 20 (FIG. 4); however, the front tubular member will hereafter be referred to as a single assembly identified in conjunction with reference number 14. The front tubular member 14 includes a first externally threaded end 22 and an opposed conically configured end 24 that terminates in an open-ended tip 26.

Figure 4:
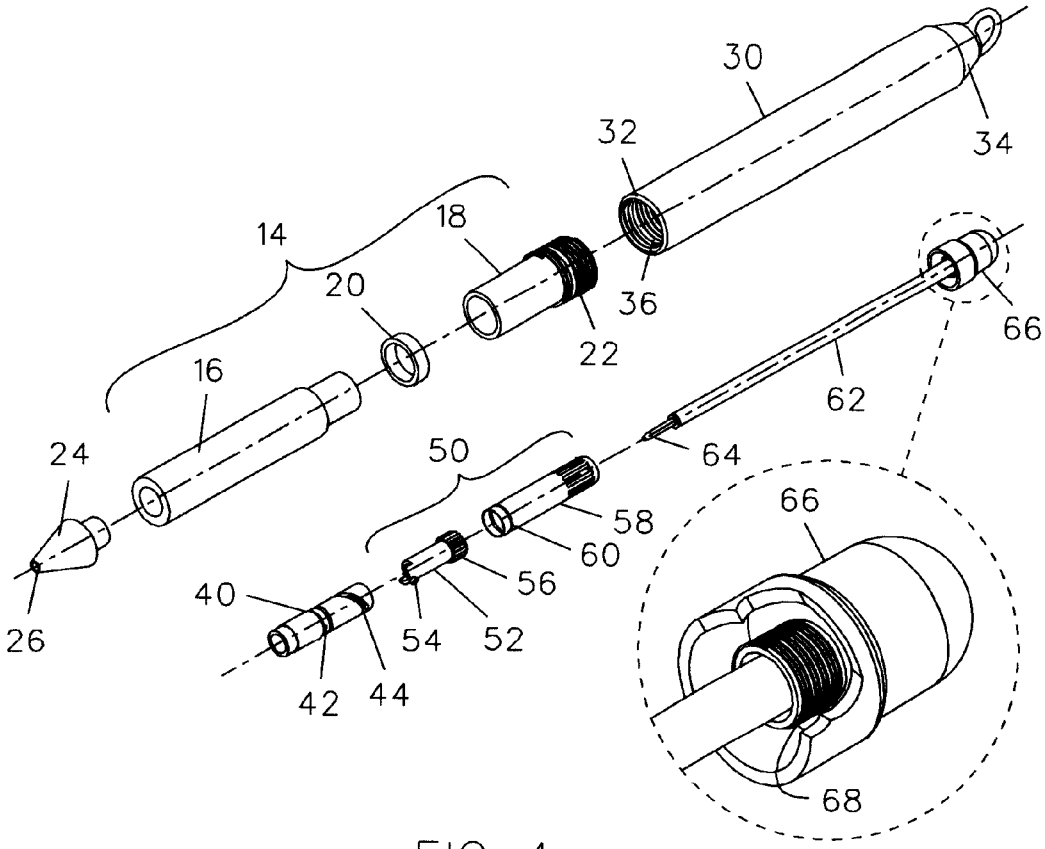
FIG. 4 is an exploded view of the writing instrument of FIG. 2.
Figure 5:
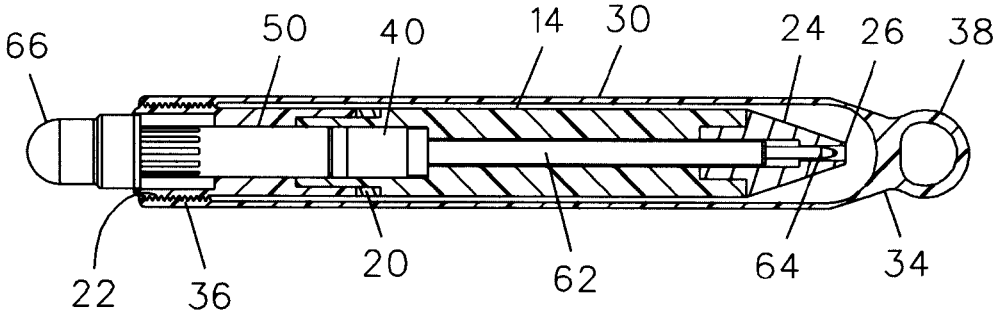
FIG. 5 is a sectional view of the writing instrument taken along line 5—5 of FIG. 1.

The rear tubular member 30 has a diameter slightly greater than a diameter of the front tubular member 14 and defines opposed open 32 and closed 34 ends (FIGS. 2 and 4). The rear tubular member 30 is internally threaded 36 adjacent the open end 32 for engaging the threaded end 22 of the front tubular member 14. Therefore, the front tubular member 14 may be inserted tip-end first into the rear tubular member 30 and threadably coupled thereto (FIG. 1) or threadably coupled such that the tip-end extends longitudinally away from said open end 32 (FIGS. 2 and 3). The rear tubular member 30 is slightly longer than the front tubular member 14 such that the front tubular member 14 may be completely inserted therein (FIG. 5). The closed end 34 of the rear tubular member 30 is slightly beveled or rounded. A loop fastener 38 is fixedly attached to the closed end 34 such that the rear tubular member 30 may be coupled to a key ring 12 (FIG. 1).

The writing instrument 10 further includes an inner front tubular member 40 inserted within the front tubular member 14. The inner front tubular member 40 is held tightly in the front member 14 in a friction fit relationship and is not rotatable relative thereto. The inner front tubular member 40 defines a groove 42 radially extending thereabout and defines an inclined path 44 adjacent an end thereof, the path 44 extending at an oblique angle relative to the longitudinal axis of the inner front tubular member 40 (FIG. 4).

A tubular actuator member 50 is coupled to the inner front tubular member 40 and is rotatable thereabout. The actuator member 50 includes a first portion 52 inserted within a second portion 58 (FIG. 4). The second portion 58 defines open ends and includes an inwardly protruding nub 60 extending radially thereabout adjacent one end that is complementary to the groove in the inner front tubular member 40 such that the second portion 58 may be snappably coupled thereto. The second portion 58 is rotatable about the inner front tubular member 40. The first portion includes a hub 54 at a forward end and rearward end 56 defining external longitudinal grooves. The hub 54 is on figured to engage the inclined path 44 of the inner front tubular member 40 and is rotatable therein between first and second ends thereof. The rearward ends of the first 52 and second 58 portions include complementary mating longitudinal grooves such that the portions rotate in unison. The first 52 and second 58 portions are singly referred to hereafter as the actuation member 50.

A writing refill 62 is removably inserted in the actuator member 50 and inner front tubular member 40. The refill 62 includes a writing tip 64 at the forward end and a cap-like knob 66 fixedly attached to the rearward end. The knob 66 is not rotatable about the refill. The knob 66 includes an externally threaded portion 68 (FIG. 4) that engages an internally recessed interiorly threaded portion (not shown) of the threaded end 56 of the actuator member 50 such that a rotation of the knob 66 causes a corresponding rotation of the actuator member 50. Therefore, as the knob 66, refill 62, and actuator member 50 are rotated in a clockwise direction, the hub 54 moves forwardly along the inclined path 44 which extends the writing tip 64 in a forward direction until it extends out of the conical tip end 26 of the front tubular member 14. Conversely, a counter-clockwise rotation causes a retraction of the writing tip 64 into the inner front tubular member 40. Of course, a continued counter-clockwise rotation of the knob 66 would result in complete removal of the refill such as for replacement.

In use, the writing instrument 10 may be carried in a compact, storage configuration as shown in FIG. 1 in which the front tubular member 14 is threadably inserted in the rear tubular member 30. Only the knob 66 extends from an open end 32 of the rear tubular member 30 in this configuration. The writing instrument 10 may be removably coupled to a key ring 12 with the loop fastener 38 for convenient transport. The front tubular member 14 may be threadably removed from the rear tubular member 30 when use as a writing instrument is desired. While the tubular members are separated (FIG. 2), the knob 66 may be rotated in a clockwise direction so as to extend the refill writing element 64 from the tip end 26 of the front tubular member 14. The threaded end 22 of the front tubular member may then be threadably coupled once again to the threaded open end 32 of the rear tubular member 30, but positioned such that the tip end 26 of the front tubular member 14 extends away from the rear tubular member 30 (FIG. 3). Following use, the tubular members may be threadably separated. The writing element 64 may then be retracted with a counter-clockwise rotation of the knob 66. Finally, the front tubular member 14 may be inserted into the rear tubular member 30 and threadably coupled thereto (FIG. 1).

Figure 6:
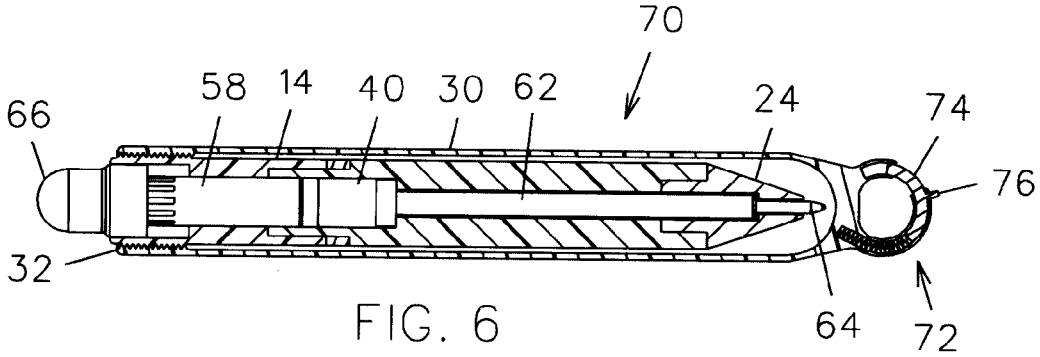
FIG. 6 is a sectional view as in FIG. 5 according to another embodiment of the present invention with the writing refill in an extended configuration.
Figure 7:
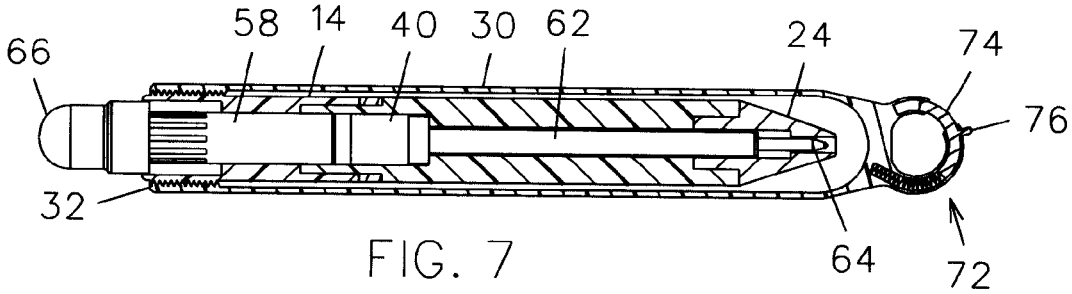
FIG. 7 is a sectional view as in FIG. 6 with the writing refill in a retracted configuration.
Figure 8:
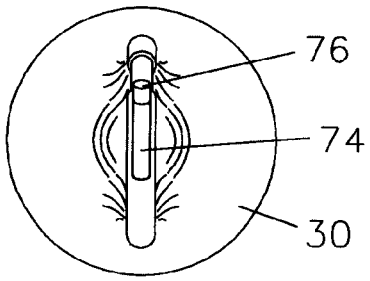
FIG. 8 is an end view of the writing instrument as in FIG. 6.

Another embodiment of the writing instrument 70 is shown in FIGS. 6–8 and is substantially similar to that described above except as specifically noted below. A spring-biased loop fastener 72 is fixedly attached to the closed end 34 of the rear tubular member 30. The loop fastener 72 includes a spring-biased slider 74 that is movable between a normally closed configuration and a biased open configuration. In the open configuration, a key ring may be directly inserted into the loop fastener and captured therein when the slider 74 is allowed to springably return to its unbiased closed configuration. The slider 74 includes a flange 76 extending therefrom for user operation thereof.

It is understood that while certain forms of this invention have been illustrated and described, it is not limited thereto except insofar as such limitations are included in the following claims and allowable functional equivalents thereof.

Having thus described the invention, what is claimed as new and desired to be secured by letters patent is as follows:

1. A writing instrument, comprising:

a front tubular member having a first threaded end and a second end;

a rear tubular member defining an open end adapted to removably receive said first threaded end of said front tubular member;

an inner front tubular member disposed in said front tubular member in a friction fit relationship;

a tubular actuator member coupled to said inner front tubular member and rotatable relative thereto, said actuator member having a first threaded end;

a writing refill inserted in said actuator member and said inner front tubular member, said refill having a writing element disposed at one end and a knob fixedly attached to an opposed end thereof, said knob having threads adapted to engage said first threaded end of said actuator member;

said inner front tubular member defining an inclined path extending at an oblique angle relative to the axis of said inner front tubular member, said inclined path having a first end and a second end; and a hub extending from a second end of said actuator member and engaging said inclined path, said hub being slidable in said inclined path between said first and second ends thereof upon a rotation of said actuator member, whereby said writing element of said refill is selectively extended or retracted from said inner front tubular member upon a rotation of said knob by a user.

2. A writing instrument as in claim 1 wherein said rear tubular member includes threads adjacent said open end adapted to engage said first threaded end of said front tubular member.

3. A writing instrument as in claim 2 wherein said first threaded end of said front tubular member is adapted to engage said threads adjacent said open end of said rear tubular member with said front tubular member selectively inserted in said rear tubular member or extending longitudinally from said rear tubular member.

4. A writing instrument as in claim 1 wherein said front tubular member is adapted to be selectively inserted in said rear tubular member in a storage configuration or extend from said rear tubular member in a use configuration.

5. A writing instrument as in claim 1 further comprising means for removably coupling said rear tubular member to a key ring.

6. A writing instrument as in claim 5 wherein said coupling means is a loop fixedly attached to a second end of said rear tubular member.

7. A writing instrument as in claim 5 wherein said coupling means includes a fastener having a spring biased slider adapted to be selectively moved between open and closed configurations.

8. A writing instrument as in claim 1 wherein said knob includes a threaded portion adapted to engage said first threaded end of said actuator member such that a rotation of said knob causes a rotation of said actuator member.

9. A writing instrument, comprising:

a front tubular member having a first externally threaded end and a second end having a conical configuration with an open tip end;

a rear tubular member having a closed first end and defining an open second end, said second end being internally threaded and adapted to engage said first threaded end of said front tubular member;

an inner front tubular member disposed in said front tubular member and unrotatable therein;

a tubular actuator member coupled to said inner front tubular member and rotatable relative thereto, said actuator member having a first end threaded externally and internally;

a writing refill releasably inserted in said actuator member and said inner front tubular member, said refill having a writing element at one end;

a knob attached to an opposed end of said writing refill, said knob having an externally threaded portion adapted to engage said first threaded end of said actuator member;

said inner front tubular member defining an inclined path extending at an oblique angle relative to a longitudinal axis of said inner front tubular member, said inclined path having a first end and a second end; and a hub extending from a second end of said actuator member and engaging said inclined path, said hub being slidable in said inclined path between said first and second ends thereof upon a rotation of said actuator member, whereby said writing element of said refill is selectively extended or retracted from said inner front tubular member upon a rotation of said knob by a user.

10. A writing instrument as in claim 9 wherein said first threaded end of said front tubular member is adapted to engage said open second end of said rear tubular member when said front tubular member is selectively positioned for insertion in said rear tubular member or for extension longitudinally from said open end of said rear tubular member.

11. A writing instrument as in claim 9 further comprising means for releasably coupling said rear tubular member to a key ring.

12. A writing instrument as in claim 11 wherein said coupling means is a loop fixedly attached to said closed first end of said rear tubular member.

13. A writing instrument as in claim 11 wherein said coupling means includes a fastener having a spring biased slider adapted to be selectively moved between open and closed configurations.

14. A writing instrument as in claim 9 wherein said knob includes a generally tubular configuration and is axially coupled to said opposed end of said refill such that said refill is rotated upon a user rotation of said knob.

15. A writing instrument as in claim 9 wherein said knob extends from said open second end of said rear tubular member when said front tubular member is inserted in said rear tubular member in a storage configuration.

* * * * *